US008297347B2

(12) United States Patent
Ruark et al.

(10) Patent No.: US 8,297,347 B2
(45) Date of Patent: Oct. 30, 2012

(54) METHOD OF CONTROLLING TORQUE APPLIED TO A TUBULAR CONNECTION

(75) Inventors: Graham Ruark, Houston, TX (US); Merlin Perry, Kingwood, TX (US); Aaron Dauphine, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 402 days.

(21) Appl. No.: 12/429,706

(22) Filed: Apr. 24, 2009

(65) Prior Publication Data

US 2009/0266539 A1 Oct. 29, 2009

Related U.S. Application Data

(60) Provisional application No. 61/048,071, filed on Apr. 25, 2008.

(51) Int. Cl.
*E21B 19/16* (2006.01)

(52) U.S. Cl. ..... 166/77.51; 166/66; 166/250.01; 166/380

(58) Field of Classification Search ..... 166/77.51, 166/250.01, 64, 113, 77.1, 66, 380
See application file for complete search history.

(56) References Cited

U.S. PATENT DOCUMENTS 3,368,396 A * 2/1968 Van Burkleo et al. ..... 73/862.25
3,594,587 A * 7/1971 Martens et al. ..... 307/149
3,745,820 A * 7/1973 Weiner ..... 73/862.25
3,855,857 A * 12/1974 Claycomb ..... 73/152.59
4,008,773 A * 2/1977 Wallace et al. ..... 173/181
4,091,451 A * 5/1978 Weiner et al. ..... 700/275
4,106,176 A * 8/1978 Rice et al. ..... 29/407.03
4,176,436 A * 12/1979 McCombs et al. ..... 29/240
4,365,402 A * 12/1982 McCombs et al. ..... 29/407.03
4,402,052 A * 8/1983 Stone et al. ..... 700/159
4,404,559 A * 9/1983 Renner ..... 340/870.28
4,592,125 A * 6/1986 Skene ..... 29/407.03
4,709,182 A * 11/1987 Wenske et al. ..... 310/316.01
4,715,451 A * 12/1987 Bseisu et al. ..... 175/40
4,867,236 A * 9/1989 Haney et al. ..... 166/77.51
4,875,530 A * 10/1989 Frink et al. ..... 175/27
5,205,163 A * 4/1993 Sananikone ..... 73/152.48
5,245,265 A 9/1993 Clay
5,245,877 A * 9/1993 Ruark ..... 73/862.621

(Continued)

FOREIGN PATENT DOCUMENTS

GB 2099620 12/1982

(Continued)

OTHER PUBLICATIONS

PCT Written Opinion and Search Report for International Application No. PCT/US2009/041651 dated Feb. 22, 2011.

(Continued)

*Primary Examiner* — Giovanna Wright
(74) *Attorney, Agent, or Firm* — Patterson & Sheridan, L.L.P.

(57) ABSTRACT

Embodiments of the present invention generally relate to a method for controlling the torque applied to a tubular connection. In one embodiment, a method of connecting a first threaded tubular to a second threaded tubular supported by a spider on a drilling rig includes engaging the first threaded tubular with the second threaded tubular; making up the connection by rotating the first tubular using a top drive; and controlling unwinding of the first tubular after the connection is made up.

39 Claims, 11 Drawing Sheets

U.S. PATENT DOCUMENTS 5,272,925 A * 12/1993 Henneuse et al. ..... 73/862.541
5,402,688 A * 4/1995 Okada et al. ..... 73/862.23
5,637,968 A * 6/1997 Kainec et al. ..... 318/432
5,689,871 A * 11/1997 Carstensen ..... 29/401.1
6,241,032 B1 * 6/2001 Falgout, Sr. ..... 175/318
6,374,706 B1 * 4/2002 Newman ..... 81/57.34
6,516,896 B1 * 2/2003 Bookshar et al. ..... 173/1
6,536,520 B1 * 3/2003 Snider et al. ..... 166/78.1
6,662,110 B1 * 12/2003 Bargach et al. ..... 702/6
6,814,149 B2 * 11/2004 Liess et al. ..... 166/380
7,028,585 B2 * 4/2006 Pietras et al. ..... 81/57.16
7,044,238 B2 * 5/2006 Hutchinson ..... 175/50
7,073,598 B2 * 7/2006 Haugen ..... 166/380
7,100,698 B2 * 9/2006 Kracik et al. ..... 166/380
7,286,623 B2 * 10/2007 Whetsel ..... 375/354
7,296,623 B2 * 11/2007 Koithan et al. ..... 166/250.01
7,306,054 B2 * 12/2007 Hutchinson ..... 175/45
7,318,488 B2 * 1/2008 Hutchinson ..... 175/40
7,568,522 B2 * 8/2009 Boutwell et al. ..... 166/250.01
7,588,099 B2 * 9/2009 Kracik ..... 175/24
7,594,540 B2 * 9/2009 Koithan et al. ..... 166/250.01
7,757,759 B2 * 7/2010 Jahn et al. ..... 166/250.01
7,882,902 B2 * 2/2011 Boutwell, Jr. ..... 175/40
2003/0164276 A1 * 9/2003 Snider et al. ..... 192/70.27
2003/0178847 A1 * 9/2003 Galle et al. ..... 285/333
2004/0144547 A1 * 7/2004 Koithan et al. ..... 166/380
2005/0077084 A1 4/2005 Kracik et al.
2007/0107912 A1 5/2007 Boutwell et al.
2007/0251701 A1 * 11/2007 Jahn et al. ..... 166/379
2009/0151934 A1 * 6/2009 Heidecke et al. ..... 166/250.01
2009/0266539 A1 * 10/2009 Ruark et al. ..... 166/250.01
2009/0274545 A1 * 11/2009 Liess et al. ..... 414/800
2010/0243273 A1 * 9/2010 Jahn et al. ..... 166/380

FOREIGN PATENT DOCUMENTS

GB 2115940 9/1983
WO WO-03069113 8/2003

OTHER PUBLICATIONS

Canadian Office Action for Application No. 2,722,096 dated Feb. 28, 2012.

* cited by examiner

METHOD OF CONTROLLING TORQUE APPLIED TO A TUBULAR CONNECTION

CROSS-REFERENCE TO RELATED APPLICATIONS

This application claims benefit of U.S. Provisional Pat. App. No. 61/048,071, filed Apr. 25, 2008, which is hereby incorporated by reference in its entirety.

BACKGROUND OF THE INVENTION

1. Field of the Invention

Embodiments of the present invention generally relate to a method for controlling the torque applied to a tubular connection.

2. Description of the Related Art

In wellbore construction and completion operations, a wellbore is initially formed to access hydrocarbon-bearing formations (e.g., crude oil and/or natural gas) by the use of drilling. Drilling is accomplished by utilizing a drill bit that is mounted on the end of a drill support member, commonly known as a drill string. To drill within the wellbore to a predetermined depth, the drill string is often rotated by a top drive or rotary table on a surface platform or rig, or by a downhole motor mounted towards the lower end of the drill string. After drilling to a predetermined depth, the drill string and drill bit are removed and a section of casing is lowered into the wellbore. An annular area is thus formed between the string of casing and the formation. The casing string is temporarily hung from the surface of the well. A cementing operation is then conducted in order to fill the annular area with cement. The casing string is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

A drilling rig is constructed on the earth's surface to facilitate the insertion and removal of tubular strings (e.g., drill strings or casing strings) into a wellbore. The drilling rig includes a platform and power tools such as an elevator and a spider to engage, assemble, and lower the tubulars into the wellbore. The elevator is suspended above the platform by a draw works that can raise or lower the elevator in relation to the floor of the rig. The spider is mounted in the platform floor. The elevator and spider both have slips that are capable of engaging and releasing a tubular, and are designed to work in tandem. Generally, the spider holds a tubular or tubular string that extends into the wellbore from the platform. The elevator engages a new tubular and aligns it over the tubular being held by the spider. One or more power drives, e.g. a power tong and a spinner, are then used to thread the upper and lower tubulars together. Once the tubulars are joined, the spider disengages the tubular string and the elevator lowers the tubular string through the spider until the elevator and spider are at a predetermined distance from each other. The spider then re-engages the tubular string and the elevator disengages the string and repeats the process. This sequence applies to assembling tubulars for the purpose of drilling, running casing or running wellbore components into the well. The sequence can be reversed to disassemble the tubular string.

Historically, a drilling platform includes a rotary table and a gear to turn the table. In operation, the drill string is lowered by an elevator into the rotary table and held in place by a spider. A Kelly is then threaded to the string and the rotary table is rotated, causing the Kelly and the drill string to rotate.

After thirty feet or so of drilling, the Kelly and a section of the string are lifted out of the wellbore and additional drill string is added.

The process of drilling with a Kelly is time-consuming due to the amount of time required to remove the Kelly, add drill string, reengage the Kelly, and rotate the drill string. Because operating time for a rig is very expensive, the time spent drilling with a Kelly quickly equates to substantial cost. In order to address these problems, top drives were developed. Top drive systems are equipped with a motor to provide torque for rotating the drilling string. The quill of the top drive is connected (typically by a threaded connection) to an upper end of the drill pipe in order to transmit torque to the drill pipe.

SUMMARY OF THE INVENTION

Embodiments of the present invention generally relate to a method for controlling the torque applied to a tubular connection. In one embodiment, a method of connecting a first threaded tubular to a second threaded tubular supported by a spider on a drilling rig includes: engaging the first threaded tubular with the second threaded tubular; making up the connection by rotating the first tubular using a top drive; and controlling unwinding of the first tubular after the connection is made up.

A system for connecting threaded tubular members for use in a wellbore, includes: a top drive operable to rotate a first threaded tubular relative to a second threaded tubular; and a controller operably connected to the top drive. The controller includes a torque gage; a turns sensor; and a computer operable to receive torque measurements taken by the torque gage and rotation measurements taken by the turns sensor. The computer is configured to perform an operation, including: engaging the first tubular with the second tubular; making up the connection by rotating the first threaded tubular; and controlling unwinding of the first tubular after the connection is made up.

In another embodiment, a method of connecting a first threaded tubular to a second threaded tubular supported by a spider on a drilling rig includes engaging the first tubular with the second tubular; making up the connection by rotating the first threaded tubular using a top drive; and substantially decreasing a rotational speed of the top drive at or after the connection is substantially made up and before the connection is completely made up.

In another embodiment, a method of connecting a first threaded tubular to a second threaded tubular supported by a spider on a drilling rig includes engaging the first tubular with the second tubular; and making up the connection by rotating the first threaded tubular using a top drive. The method further includes, during rotation of the first tubular: measuring torque applied by the top drive; determining angular acceleration of the top drive and/or the first tubular; determining inertial torque of the top drive and/or the first tubular using the angular acceleration; and compensating the torque measurement using the inertial torque of the top drive and/or the first tubular.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
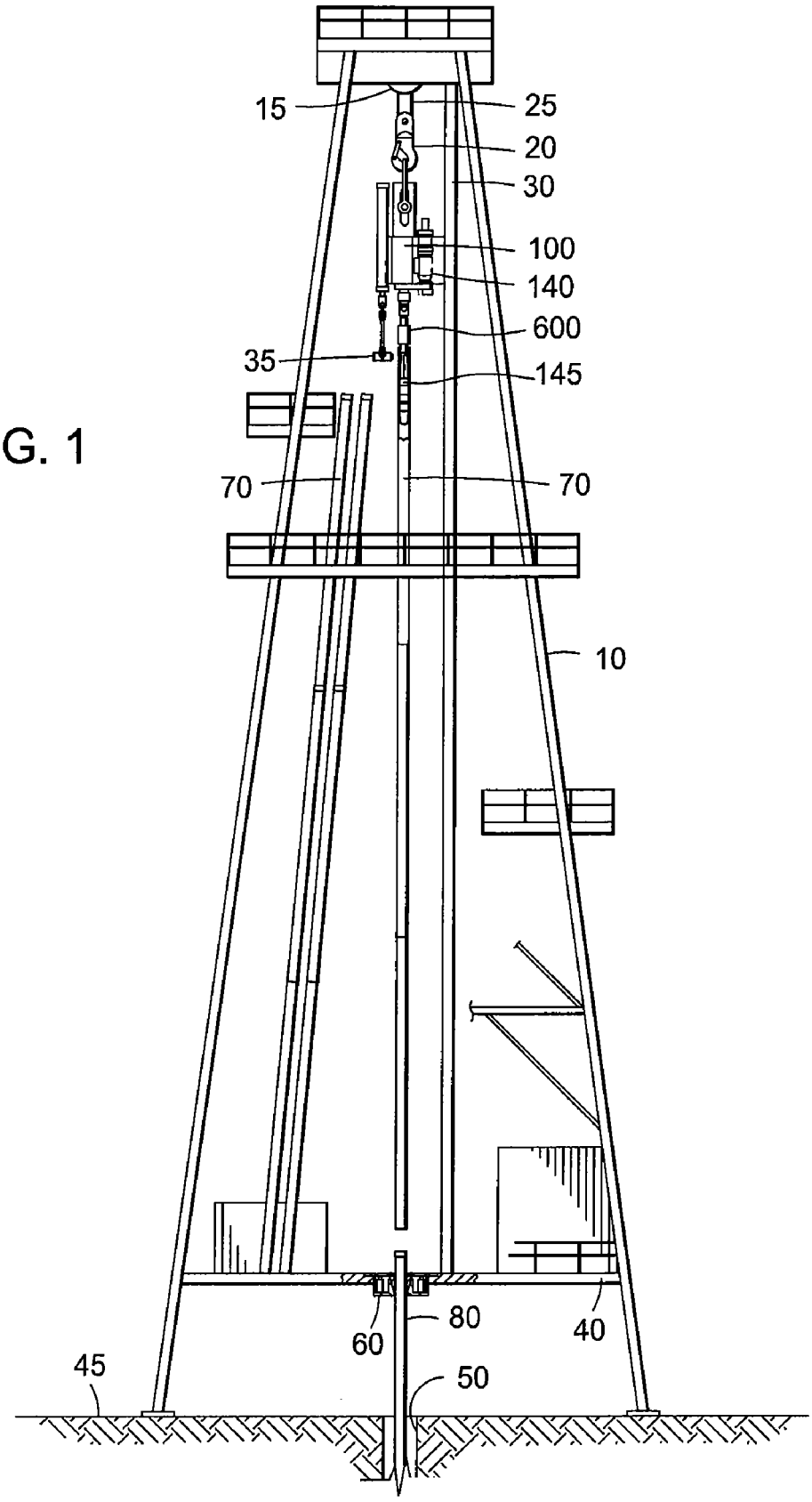
FIG. 1 is a side view of a drilling rig having a top drive, an elevator, and a spider.

FIG. 1 is a side view of a drilling rig 10 having a top drive 100, an elevator 35, and a spider 60. An upper end of a stack of tubulars 70 is shown on the rig 10. The tubular 70 may be placed in position below the top drive 100 by the elevator 35 in order for the top drive having a gripping device (e.g., a spear 145 or torque head (not shown)) to engage the tubular.

The rig 10 may be built at the surface 45 of the wellbore 50. The rig 10 may include a traveling block 20 that is suspended by wires 25 from draw works 15 and holds the top drive 100. The top drive 100 includes the spear 145 or torque head for engaging the tubular 70 and a motor 140 to rotate the tubular 70. The motor 140 may be either electrically or hydraulically driven. The motor 140 rotates and threads the tubular 70 into the tubular string 80 extending into the wellbore 50. The motor 140 can also rotate a drill string having a drill bit at an end, or for any other purposes requiring rotational movement of a tubular or a tubular string. Additionally, the top drive 100 is shown having a railing system 30 coupled thereto. The railing system 30 prevents the top drive 100 from rotational movement during rotation of the tubular 70, but allows for vertical movement of the top drive under the traveling block 110.

With the tubular 70 positioned over the tubular string 80, the top drive 100 may lower and thread the tubular into the tubular string. Additionally, the spider 60, disposed in a platform 40 of the drilling rig 100, is shown engaged around the tubular string 80 that extends into wellbore 50.

The elevator 35 and the top drive 100 may be connected to the traveling block 20 via a compensator. The compensator may function similar to a spring to compensate for vertical movement of the top drive 100 during threading of the tubular 70 to the tubular string 80. In addition to its motor 140, the top drive may include a torque sub 600 (see FIG. 2) to measure torque and rotation of the tubular 70 as it is being threaded to tubular string 80. The torque sub 600 may transmit the torque and rotation data about the threaded joint to a makeup controller 700. The controller 700 may be preprogrammed with acceptable values for rotation and torque for a particular joint. The controller may compare the rotation and the torque data to the stored acceptable values.

The spider 60, torque head, and spear may each include slips, a bowl, and a piston. The slips may be wedge-shaped arranged to slide along a sloped inner wall of the bowl. The slips may be raised or lowered by the piston. When the slips are in the lowered position, they may close around/against the inner/outer surface of the respective tubulars 70, 80. The weight of the tubulars 70, 80 and the resulting friction between the tubulars 70, 80 and the slips may force the slips downward and inward, thereby tightening the grip on the tubular string. When the slips are in the raised position, the slips are opened and the tubulars 70, 80 are free to move longitudinally in relation to the slips.

The tubular string 80 may be retained in a closed spider 60 and is thereby prevented from moving in a downward direction. The top drive 100 may then be moved to engage the tubular 70 from a stack with the aid of the elevator 35. The tubular 70 may be a single tubular or a stand (typically be made up of two or three tubulars threaded together). Engagement of the tubular 70 by the top drive 100 includes grasping the tubular and engaging the inner or outer surface thereof using the torque head or spear. The top drive 100 then moves the tubular 70 into position above the tubular string 80. The top drive 100 may then rotate the tubular 70 relative to the tubular string 80, thereby making up a threaded connection between the tubulars 70, 80.

The spider 60 may then be opened and disengage the tubular string 80. The top drive 100 may then lower the tubular string 70, 80 through the opened spider 60. The spider 60 may then be closed around the tubular string 80. The top drive 100 may then disengage the tubular string 80 and can proceed to add another tubular 70 to the tubular string 80. The above-described acts may be utilized in running drill string in a drilling operation, running casing or liner to reinforce and/or drill the wellbore, or for assembling work strings to place wellbore components in the wellbore. The steps may also be reversed in order to disassemble the tubular string.

Figure 2:
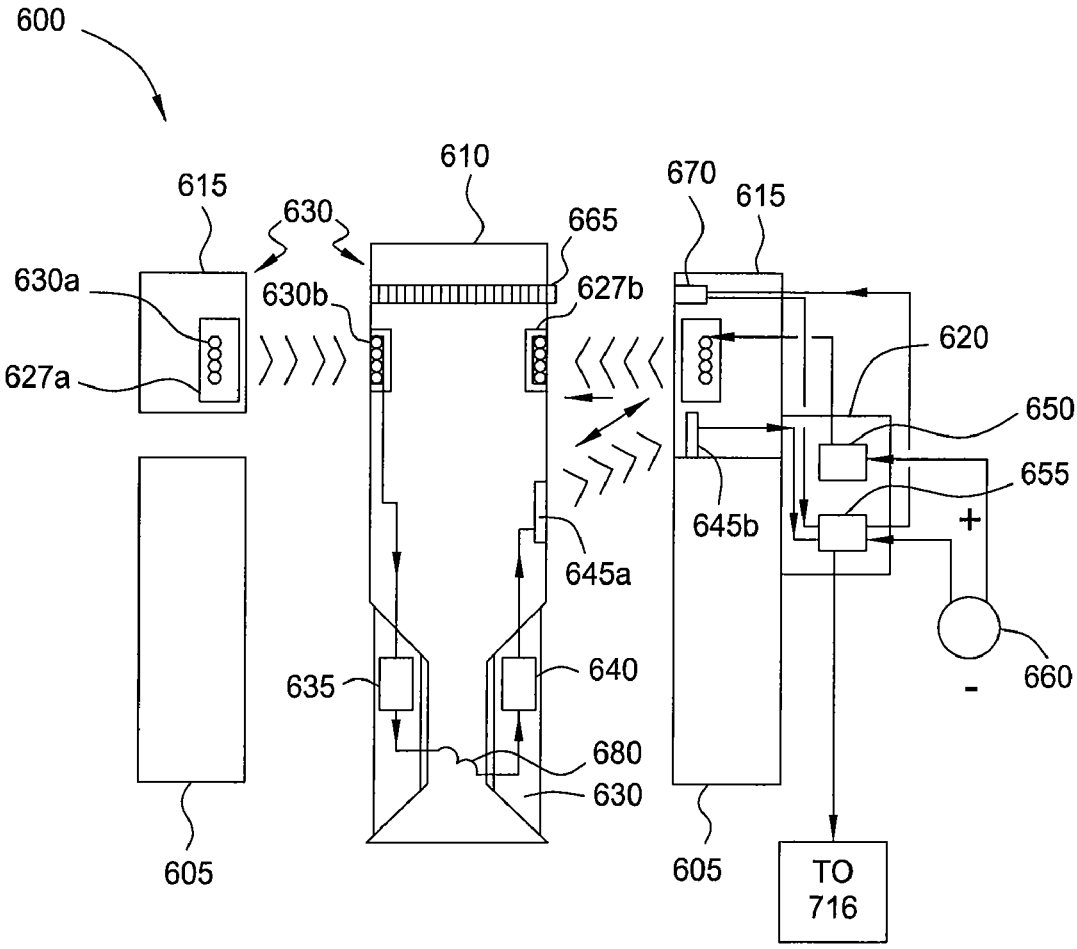
FIG. 2 is a diagram showing a torque sub.

FIG. 2 illustrates the torque sub 600. The torque sub 600 may be connected to a quill of the top drive 100 for measuring a torque applied by the top drive 100. The torque sub may include a housing 605, a torque shaft 610 rotationally and longitudinally coupled to the quill of the top drive, an interface 615, and a controller 620. The housing 605 may be a tubular member having a bore therethrough. The interface 615 and the controller 620 may both be mounted on the housing 605. The interface 615 may be made from a polymer. The torque shaft 610 may extend through the bore of the housing 605. The torque shaft 610 may include one or more longitudinal slots, a groove, a reduced diameter portion, a sleeve (not shown), and a polymer shield (not shown).

The groove may receive a secondary coil 630*b* which is wrapped therein. Disposed on an outer surface of the reduced diameter portion may be one or more strain gages 680. Each strain gage 680 may be made of a thin foil grid and bonded to the tapered portion of the torque shaft 610 by a polymer support, such as an epoxy glue. The foil strain gauges 680 may be made from metal, such as platinum, tungsten/nickel, or chromium. Four strain gages 680 may be arranged in a Wheatstone bridge configuration. The strain gages 680 may be disposed on the reduced diameter portion at a sufficient distance from either taper so that stress/strain transition effects at the tapers are fully dissipated. Strain gages 680 may be arranged to measure torque and longitudinal load on the torque shaft 610. The slots may provide a path for wiring between the secondary coil 630*b* and the strain gages 680 and also house an antenna 645*a*.

The shield may be disposed proximate to the outer surface of the reduced diameter portion. The shield may be applied as a coating or thick film over strain gages 680. Disposed between the shield and the sleeve may be electronic components 635,640. The electronic components 635,640 may be encased in a polymer mold 630. The shield may absorb any forces that the mold 630 may otherwise exert on the strain gages 680 due to the hardening of the mold. The shield may also protect the delicate strain gages 680 from any chemicals present at the wellsite that may otherwise be inadvertently splattered on the strain gages 680. The sleeve may be disposed along the reduced diameter portion. A recess may be formed in each of the tapers to seat the shield. The sleeve forms a substantially continuous outside diameter of the torque shaft 610 through the reduced diameter portion. The sleeve also has an injection port formed therethrough (not shown) for filling fluid mold material to encase the electronic components 635,640.

A power source 660 may be provided in the form of a battery pack in the controller 620, an on-site generator, utility lines, or other suitable power source. The power source 660 may be electrically coupled to a sine wave generator 650. The sine wave generator 650 may output a sine wave signal having a frequency less than nine kHz to avoid electromagnetic interference. The sine wave generator 650 may be in electrical communication with a primary coil 630*a* of an electrical power coupling 630.

The electrical power coupling 630 may be an inductive energy transfer device. Even though the coupling 630 transfers energy between the non-rotating interface 615 and the rotatable torque shaft 610, the coupling 630 may be devoid of any mechanical contact between the interface 615 and the torque shaft 610. In general, the coupling 630 may act similarly to a common transformer in that it employs electromagnetic induction to transfer electrical energy from one circuit, via its primary coil 630*a*, to another, via its secondary coil 630*b*, and does so without direct connection between circuits. The coupling 630 includes the secondary coil 630*b* mounted on the rotatable torque shaft 610. The primary 630*a* and secondary 630*b* coils may be structurally decoupled from each other.

The primary coil 630*a* may be encased in a polymer 627*a*, such as epoxy. The secondary coil 630*b* may be wrapped around a coil housing 627*b* disposed in the groove. The coil housing 627*b* may be made from a polymer and may be assembled from two halves to facilitate insertion around the groove. The secondary coil 630*b* may then molded in the coil housing 627*b* with a polymer. The primary 630*a* and secondary coils 630*b* may be made from an electrically conductive material, such as copper, copper alloy, aluminum, or aluminum alloy. The primary 630*a* and/or secondary 630*b* coils may be jacketed with an insulating polymer. In operation, the alternating current (AC) signal generated by sine wave generator 650 is applied to the primary coil 630*a*. When the AC flows through the primary coil 630*a*, the resulting magnetic flux induces an AC signal across the secondary coil 630*b*. The induced voltage causes a current to flow to rectifier and direct current (DC) voltage regulator (DCRR) 635. A constant power is transmitted to the DCRR 635, even when the torque shaft 610 is rotated by the top drive 100.

The DCRR 635 may convert the induced AC signal from the secondary coil 630*b* into a suitable DC signal for use by the other electrical components of the torque shaft 610. In one embodiment, the DCRR outputs a first signal to the strain gages 680 and a second signal to an amplifier and microprocessor controller (AMC) 640. The first signal is split into sub-signals which flow across the strain gages 680, are then amplified by the amplifier 640, and are fed to the microprocessor controller 640. The microprocessor controller 640 converts the analog signals from the strain gages 680 into digital signals, multiplexes them into a data stream, and outputs the data stream to a modem associated with microprocessor controller 640. The modem modulates the data stream for transmission from antenna 645*a*. The antenna 645*a* transmits the encoded data stream to an antenna 645*b* disposed in the interface 615. The antenna 645*b* sends the received data stream to a modem 655, which demodulates the data signal and outputs it to the controller 620.

The torque sub 600 may further include a turns counter 665, 670. The turns counter may include a turns gear 665 and a proximity sensor 670. The turns gear 665 may be rotationally coupled to the torque shaft 610. The proximity sensor 670 may be disposed in the interface 615 for sensing movement of the gear 665. The sensor 670 may send an output signal to the controller 620. Alternatively, a friction wheel/encoder device or a gear and pinion arrangement may be used to measure turns of the torque shaft 610. The controller 620 may process the data from the strain gages 680 and the proximity sensor 670 to calculate respective torque, longitudinal load, and turns values therefrom. For example, the controller 620 may de-code the data stream from the strain gages 680, combine that data stream with the turns data, and re-format the data into a usable input (e.g., analog, field bus, or Ethernet) for a make-up system 700.

When joining lengths of tubulars (e.g., production tubing, casing, liner, drill pipe, any oil country tubular good, etc.; collectively referred to herein as tubulars) for oil wells, it is conventional to form such lengths of tubing to standards prescribed by the American Petroleum Institute (API). Each length of tubing has an internal threading at one end and an external threading at another end. The externally-threaded end of one length of tubing is adapted to engage in the internally-threaded end of another length of tubing. API type connections between lengths of such tubing rely on thread interference and the interposition of a thread compound to provide a seal.

For some tubular strings, such API type connections are not sufficiently secure or leakproof. In particular, as the petroleum industry has drilled deeper into the earth during exploration and production, increasing pressures have been encountered. In such environments, where API type connections are not suitable, it is conventional to utilize so-called "premium grade" tubing which is manufactured to at least API standards but in which a metal-to-metal sealing area is provided between the lengths. In this case, the lengths of tubing each have tapered surfaces which engage one another to form the metal-to-metal sealing area. Engagement of the tapered surfaces is referred to as the "shoulder" position/condition. Whether the threaded tubulars are of the API type or are premium grade connections, methods are needed to ensure a good connection.

Figure 3A:
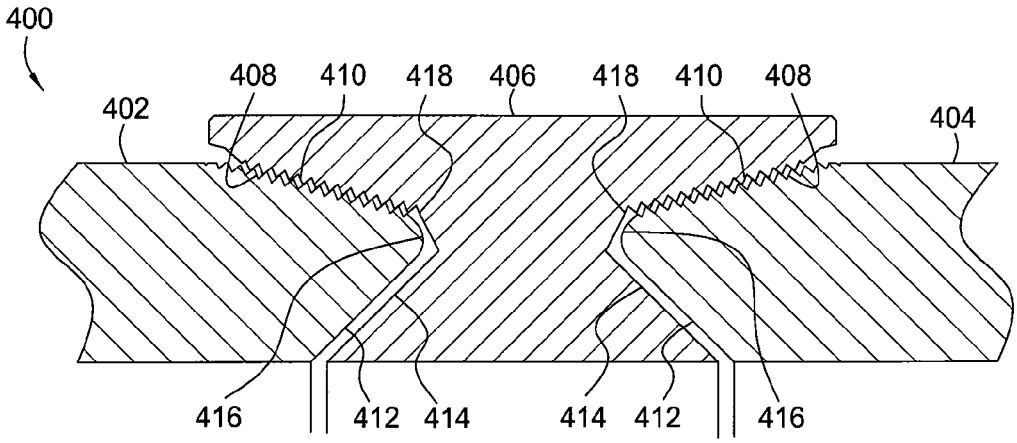
FIG. 3A is a partial cross section view of a connection between threaded premium grade tubulars.

FIG. 3A illustrates one form of a premium grade tubing connection 400. In particular, FIG. 3A shows a tapered premium grade tubing assembly 400 having a first tubular 402 joined to a second tubular 404 through a tubing coupling or box 406. The end of each tubular 402,404 has a tapered externally-threaded surface 408 which co-operates with a correspondingly tapered internally-threaded surface 410 on the coupling 406. Each tubular 402,404 is provided with a torque shoulder 412 which co-operates with a corresponding torque shoulder 414 on the coupling 406. At a terminal end of each tubular 402,404, there is defined an annular sealing area 416 which is engageable with a co-operating annular sealing area 418 defined between the tapered portions 410,414 of the coupling 406. Alternatively, the sealing area 416 may be located at other positions in the connection.

Figure 3B:
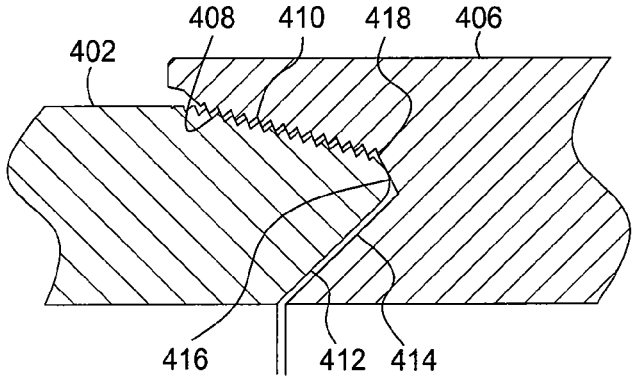
FIG. 3B is a partial cross section view of a connection between threaded premium grade tubulars in which a seal condition is formed by engagement between sealing surfaces.
Figure 3C:
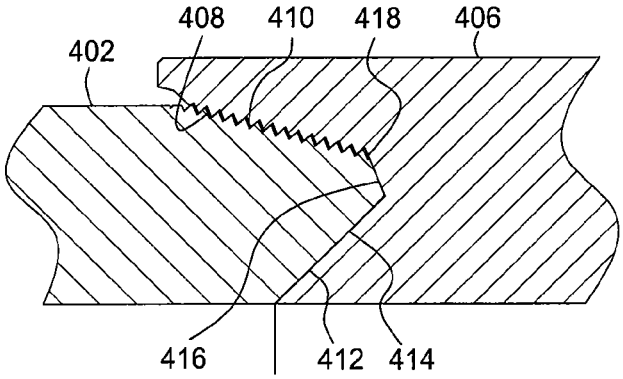
FIG. 3C is a partial cross section view of a connection between threaded premium grade tubulars in which a shoulder condition is formed by engagement between shoulder surfaces.

During make-up, the tubulars 402, 404 (also known as pins), are engaged with the box 406 and then threaded into the box by relative rotation therewith. During continued rotation, the annular sealing areas 416, 418 contact one another, as shown in FIG. 3B. This initial contact is referred to as the "seal condition". As the tubing lengths 402,404 are further rotated, the co-operating tapered torque shoulders 412,414 contact and bear against one another at a machine detectable stage referred to as a "shoulder condition" or "shoulder torque", as shown in FIG. 3C. The increasing pressure interface between the tapered torque shoulders 412,414 cause the seals 416,418 to be forced into a tighter metal-to-metal sealing engagement with each other causing deformation of the seals 416 and eventually forming a fluid-tight seal.

Figure 4A:
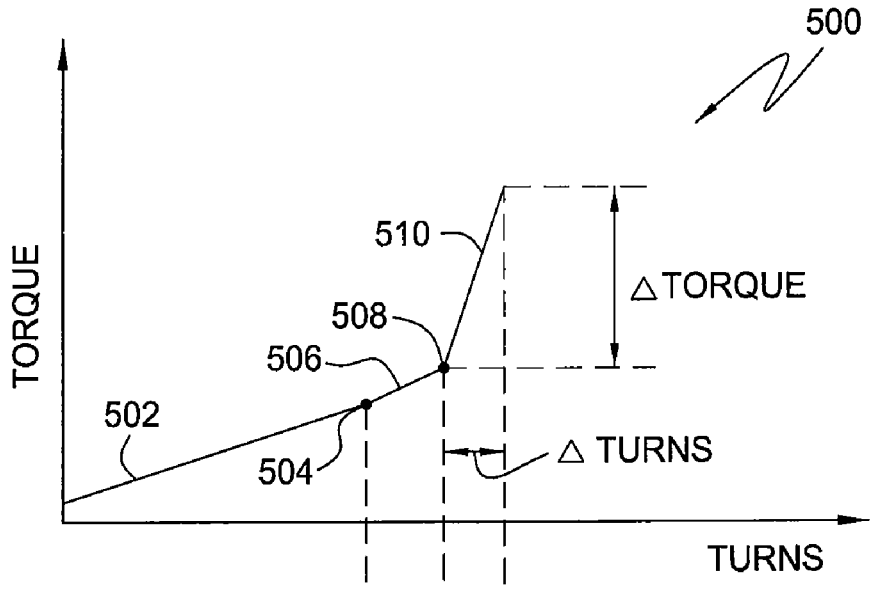
FIG. 4A illustrate a plot of torque with respect to turns for the premium connection.
Figure 4B:
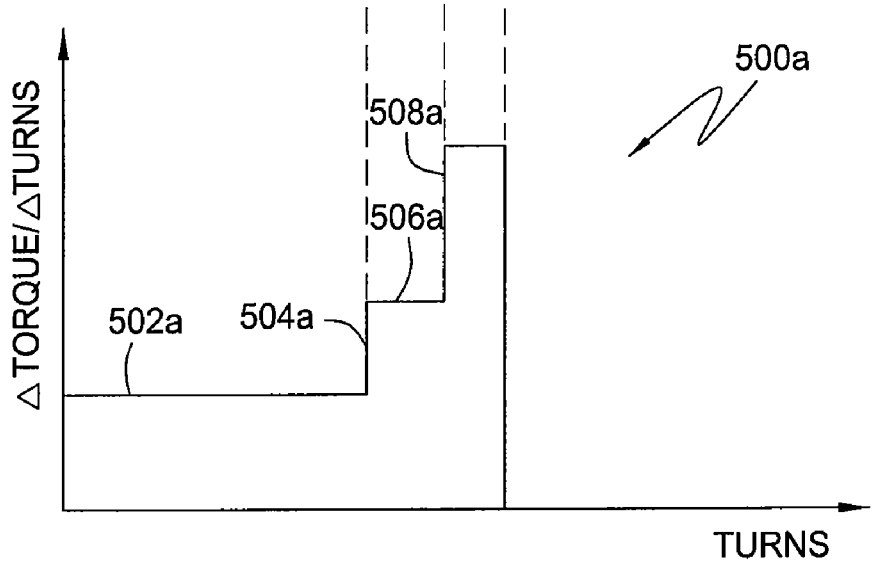
FIG. 4B illustrates plots of the rate of change in torque with respect to turns for the premium connection.

During make-up of the tubulars 402,404, torque may be plotted with respect to turns. FIG. 4A shows a typical x-y plot (curve 500) illustrating the acceptable behavior of premium grade tubulars, such as the tapered premium grade tubing assembly 400 shown in FIGS. 3A-C. FIG. 4B shows a corresponding chart plotting the rate of change in torque (y-axis) with respect to turns (x-axis). Shortly after the tubing lengths engage one another and torque is applied (corresponding to FIG. 3A), the measured torque increases substantially linearly as illustrated by curve portion 502. As a result, corresponding curve portion 502*a* of the differential curve 500*a* of FIG. 4B is flat at some positive value.

During continued rotation, the annular sealing areas 416, 418 contact one another causing a slight change (specifically, an increase) in the torque rate, as illustrated by point 504. Thus, point 504 corresponds to the seal condition shown in FIG. 3B and is plotted as the first step 504*a* of the differential curve 500*a*. The torque rate then again stabilizes resulting in the linear curve portion 506 and the plateau 506*a*. In practice, the seal condition (point 504) may be too slight to be detectable. However, in a properly behaved make-up, a discernable/detectable change in the torque rate occurs when the shoulder condition is achieved (corresponding to FIG. 3C), as represented by point 508 and step 508*a*.

Since the top drive 100 grips the tubular 402 at an end distal from the box 406 and lengths of the tubular 402 may range from about 20 ft to about 90 ft (depending on whether the tubular 402 is a single tubular or a stand of pre-made up tubulars), torsional deflection of the tubular 402 may be significant. The deflection of the tubular 402 is inherently added to the rotation value provided by the turns counter 665, 670. Deflection of the top drive and the torque head or spear may also be significant. For convenience, deflection of the tubular 402 and/or the top drive 100 (including the torque head/spear and/or torque shaft 610) will be referred to as system deflection. For an illustration of the effect of system deflection, see FIGS. 4 and 5 of U.S. Pub. App No. 2007/0107912, which is herein incorporated by reference in its entirety. Before the seal condition 504 is reached, the torque value may be relatively low, resulting in negligible error. However, even at the seal condition 504, some error may be noticeable. The length of the step 504, in curve 500*a* may be reduced and the turns value of the step may be increased by system deflection. This skew may cause some concern if the values are being compared to laboratory norms and may cause the seal condition to be mistaken for a shoulder condition.

The error may be most noticeable at and past the shoulder condition. The system deflection may cause a substantial reduction in the step 508 in curve 500*a*. This reduction could cause the shoulder detector 748 to mistake the shoulder condition for a seal condition (if the seal condition went undetected) which could result in a damaged connection. Assuming the shoulder condition is successfully detected, the make-up system 700 may then stop the make-up of the connection upon reaching a predetermined turns value. However, a substantial portion of this value may instead be system deflection, thereby resulting in a connection that is insufficiently made-up. A poorly made-up connection may at best leak and at worse separate upon service in the wellbore or in a riser system. Further, the shift at the shoulder condition could cause the make-up system 700 to reject the connection even though the connection is acceptable especially if the make-up system expects the shoulder condition to be reached in a predetermined turns range.

Figure 5:
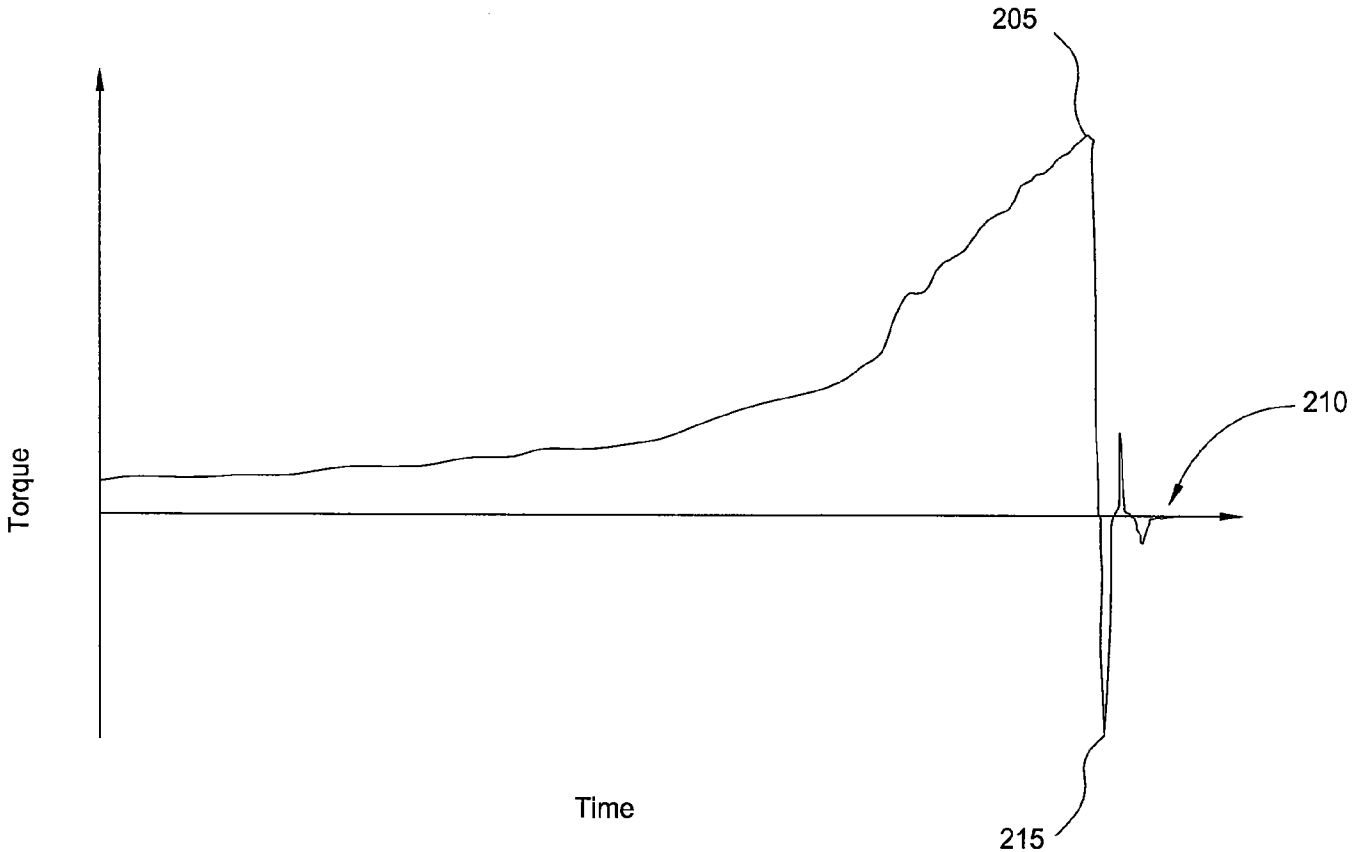
FIG. 5 illustrates post make-up release of elastic energy of the premium tubular and/or top drive.

FIG. 5 illustrates post make-up release of elastic energy of the premium tubular 402 and/or top drive 100. As discussed above, since the top drive 100 (via the torque head or spear) grips the tubular at an end distal from the connection 400, the system may deflect. Analogous to a torsion spring, elastic energy may be stored by the system so that when the connection is made up or completed 205 and the dump signal is issued to the top drive 100, the energy is released causing the tubular 402 to rotate in a breakout or loosening direction of the tubular 402 (usually counterclockwise) and then oscillate 210 until the energy dissipates. Breakout torque 215 (negative) may consequently be applied to the connection 400, potentially loosening the connection.

Figure 6A:
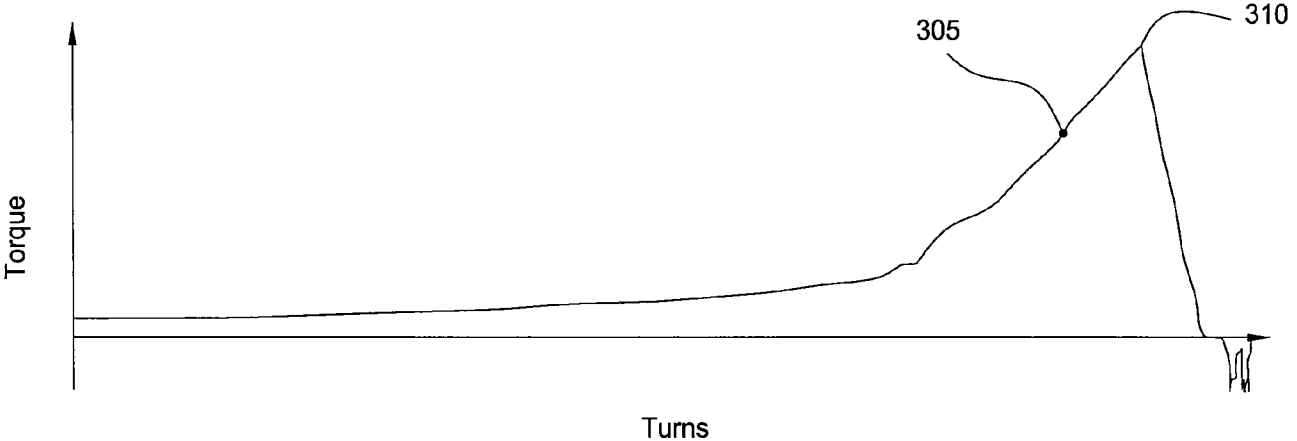
FIGS. 6A and 6B illustrate overshooting a premium connection due to kinetic energy of the top drive and/or premium tubular.
Figure 6B:
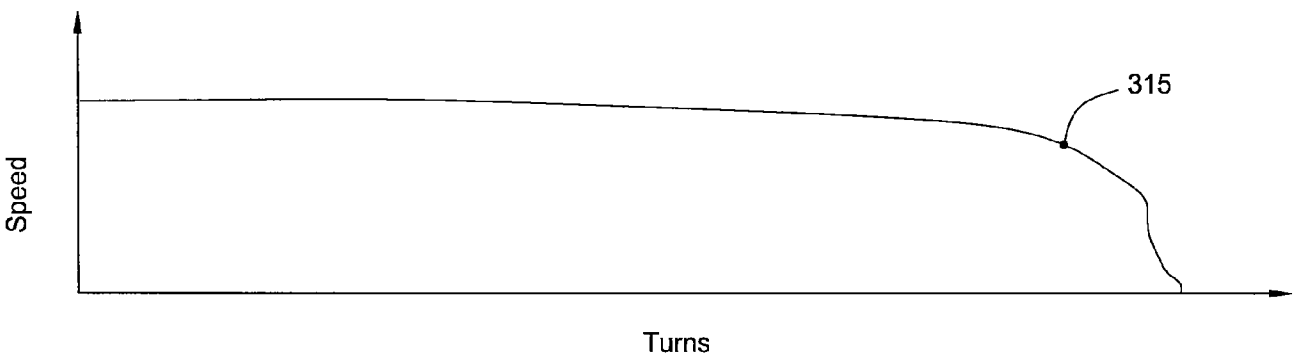

FIGS. 6A and 6B illustrate overshooting the premium connection 400 due to kinetic energy of the system. The make-up target, calculated by any of various ways discussed herein, is illustrated at 305. However, since the system is rotating at an angular speed 315 at the target 305, kinetic energy or momentum of the system may cause further rotation or overshoot after the dump signal is issued until make-up of the connection actually terminates at 310. The overshoot may cause substantial additional torque to be exerted on the connection 400, thereby damaging the connection. As discussed below in reference to FIG. 10A, the overshoot may be minimized by reducing angular speed of the top drive 100 at the target 305.

Figure 7A:
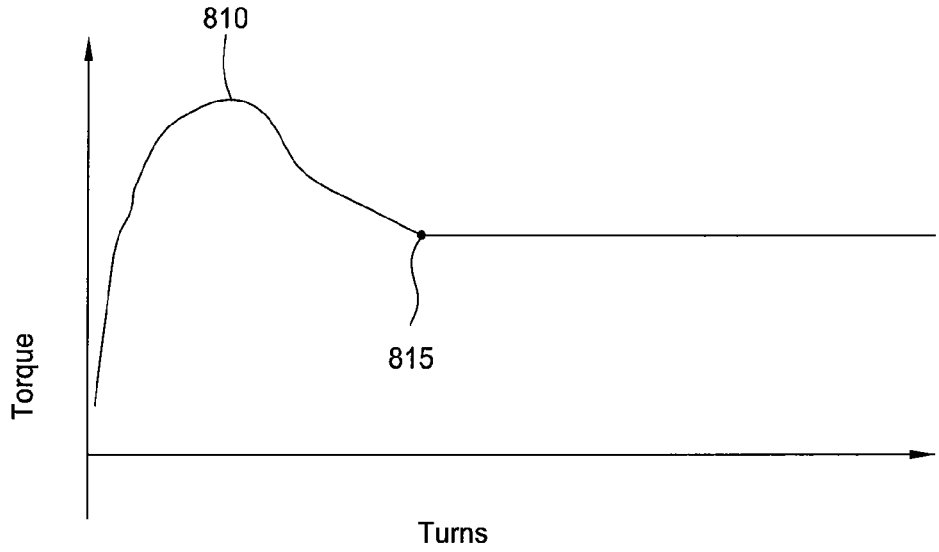
FIGS. 7A and 7B illustrate inertial torque of a premium tubular and/or top drive.
Figure 7B:
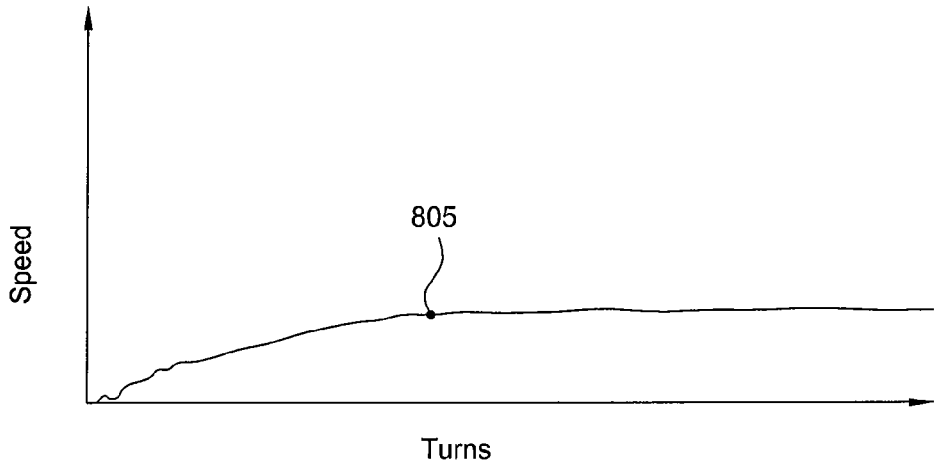

FIGS. 7A and 7B illustrate inertial torque of a premium tubular and/or top drive. The figures illustrate angular acceleration of the top drive 100 connected to the tubular string 80 while rotating the tubular string 80 (instead of making up a connection between tubular 70 and string 80). The system starts from rest and is rotationally accelerated an angular velocity at point 805 at which the angular velocity of the system is maintained at a first speed. Correspondingly, the torque increases to a maximum of 810 and then decreases to a steady state value representative of dynamic friction of the system. The difference between maximum 810 and the steady state value 815 represents the inertial torque required to accelerate the system. As applied to making up the connection 400, inertial torque due to system acceleration may cause the torque sub to measure more torque than is actually applied to the connection 400 and inertial torque due to system deceleration may cause the torque sub to measure less torque than is actually applied to the connection. Analogous to system deflection, discussed above, the inertial torque may skew the torque-turn curve and the differential torque/turn-turn curve, thereby potentially causing the connection 400 to be improperly made up.

Figure 8:
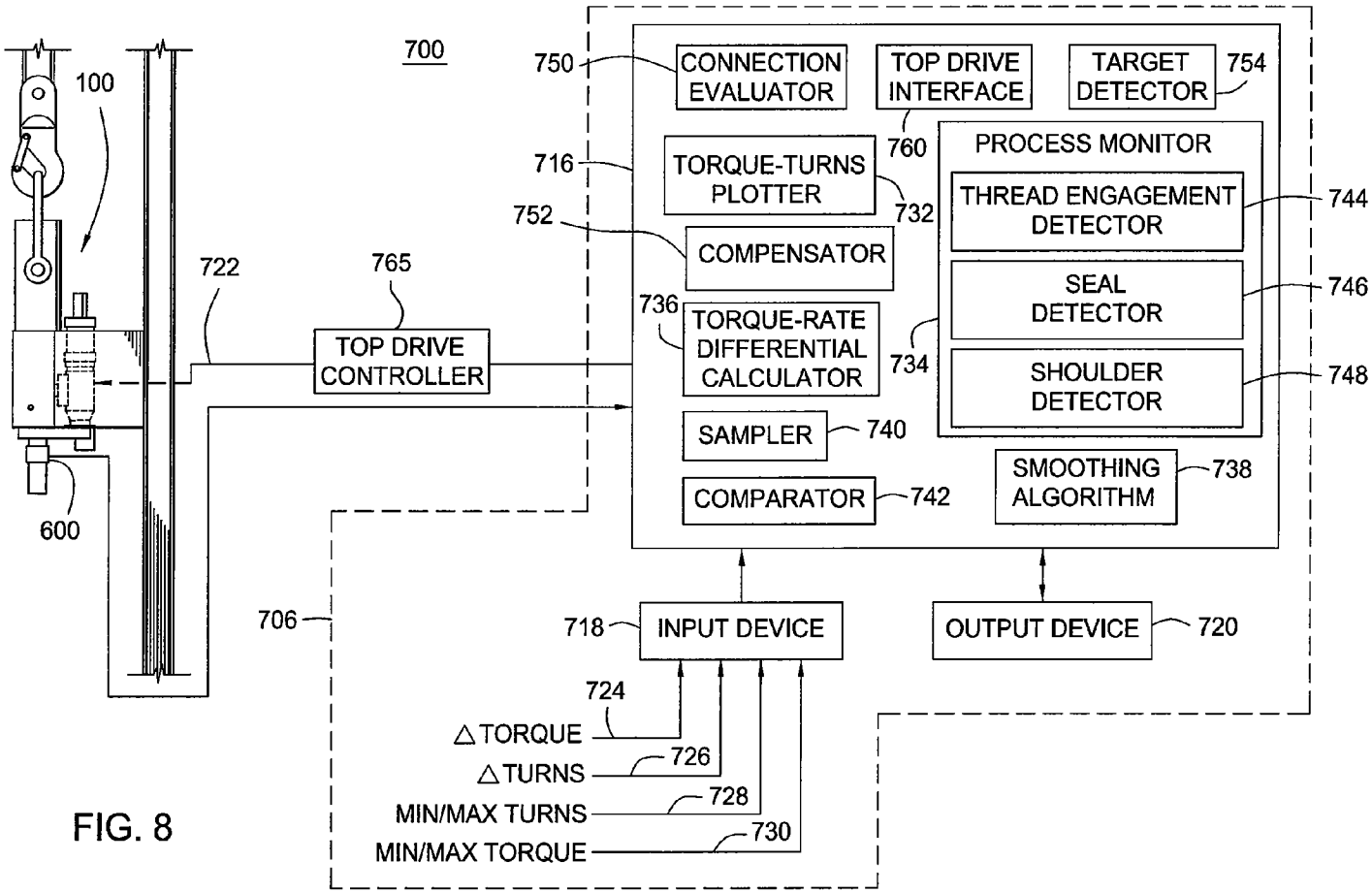
FIG. 8 is a block diagram illustrating a tubular make-up system, according to one embodiment of the present invention.

FIG. 8 is a block diagram illustrating a tubular make-up system implementing the torque sub 600 of FIG. 2. The tubular make-up system 700 may include the top drive 100, a top drive controller 765, torque sub 600, and the computer system 706. The computer system 706 may communicate with the top drive controller 765 via interface 760. Depending on sophistication of the top drive controller, the interface 760 may be analog or digital. Alternatively, the computer system 706 may also serve as the top drive controller.

A computer 716 of the computer system 706 may monitor the turns count signals and torque signals from torque sub 600 and compare the measured values of these signals with predetermined values. The predetermined values may be input by an operator for a particular tubing connection. The predetermined values may be input to the computer 716 via an input device 718, such as a keypad.

Illustrative predetermined values which may be input, by an operator or otherwise, include a delta torque value 724, a delta turns value 726, minimum and maximum turns values 728 and minimum and maximum torque values 730. During makeup of a tubing assembly, various output may be observed by an operator on output device, such as a display screen, which may be one of a plurality of output devices 720. By way of example, an operator may observe the various predefined values which have been input for a particular tubing connection. Further, the operator may observe graphical information such as a representation of the torque rate curve 500 and the torque rate differential curve 500*a*. The plurality of output devices 720 may also include a printer such as a strip chart recorder or a digital printer, or a plotter, such as an x-y plotter, to provide a hard copy output. The plurality of output devices 720 may further include a horn or other audio equipment to alert the operator of significant events occurring during make-up, such as the shoulder condition, the terminal connection position and/or a bad connection.

Upon the occurrence of a predefined event(s), the computer system 706 may output a dump signal to the top drive controller 765 to automatically shut down or reduce the torque exerted by the top drive 100. For example, dump signal 722 may be issued upon detecting the terminal connection position and/or a bad connection.

The comparison of measured turn count values and torque values with respect to predetermined values is performed by one or more functional units of the computer 716. The functional units may generally be implemented as hardware, software or a combination thereof. The functional units may include a torque-turns plotter algorithm 732, a process monitor 734, a torque rate differential calculator 736, a smoothing algorithm 738, a sampler 740, a comparator 742, and a compensator 752. The process monitor 734 may include a thread engagement detection algorithm 744, a seal detection algorithm 746 and a shoulder detection algorithm 748. Alternatively, the functional units may be performed by a single unit. As such, the functional units 732-742,752,765 may be considered logical representations, rather than well-defined and individually distinguishable components of software or hardware.

The compensator 752 may include a database of predefined values or a formula derived therefrom for various torque and system deflections resulting from application of various torque on the top drive unit 100. These values (or formula) may be calculated theoretically or measured empirically. Since the top drive unit 100 is a relatively complex machine, it may be preferable to measure deflections at various torque since a theoretical calculation may require extensive computer modeling, e.g. finite element analysis. Empirical measurement may be accomplished by substituting a rigid member, e.g. a blank tubular, for the premium grade assembly 400 and causing the top drive 100 to exert a range of torques corresponding to a range that would be exerted on the tubular grade assembly to properly make-up a connection. In the case of the top drive unit 100, the blank may be only a few feet long so as not to compromise rigidity. The torque and rotation values provided by torque sub 600, respectively, would then be monitored and recorded in a database. The test may then be repeated to provide statistical samples. Statistical analysis may then be performed to exclude anomalies and/or derive a formula. The test may also be repeated for different size tubulars to account for any change in the stiffness of the top drive 100 due to adjustment of the units for different size tubulars. Alternatively, only deflections for higher values (e.g. at a range from the shoulder condition to the terminal condition) need be measured.

Deflection of tubular member 402, may also be added into the system deflection. Theoretical formulas for this deflection may readily be available. Alternatively, instead of using a blank for testing the top drive, the end of member 402 distal from the top drive may simply be locked into a spider. The top drive 100 may then be operated across the desired torque range while measuring and recording the torque and rotation values from the torque sub 600. The measured rotation value will then be the rotational deflection of both the top drive 100 and the tubular member 402. Alternatively, the deflection compensator may only include a formula or database of torques and deflections for just the tubular member 402.

The compensator 752 may also include a moment of inertia for the tubular 402 (and may include moments of inertia for the rest of the system). These values (or formula) may be calculated theoretically or measured empirically. Since the top drive 100 is a relatively complex machine, it may be preferable to measure moments of inertia at a constant angular acceleration since a theoretical calculation may require extensive computer modeling, e.g., finite element analysis. Empirical measurement for the system may be accomplished just after the tubular 402 is engaged with the tubular 404 while the connection 400 is still loose. The top drive may be accelerated at a constant angular acceleration and the torque measured with the torque sub. The top drive 100 may then be decelerated at a constant angular deceleration and the torque again measured. The torque may be divided by the angular acceleration to determine the moment of inertia. Once the moment of inertia is known, the angular acceleration may be monitored during make up of the connection 400 to compensate the measured torque value for system inertia. Since the empirical test is relatively simple, it may be repeated for each tubular 402. Alternatively, a database of inertial torque at different angular accelerations may be instead used to compensate the torque value. Alternatively, the top drive controller may be programmed to compensate for system inertia.

In operation, two threaded members 402,404 are brought together. The box 406 is usually made-up on tubular 404 off-site before the tubulars 402,404 are transported to the rig. Alternatively, the box 406 may be welded to the tubular 404. One of the threaded members (e.g., tubular 402) is rotated by the top drive 100 while the other tubular 404 is held by the spider 60. The applied torque and rotation are measured at regular intervals throughout a pipe connection makeup. In one embodiment, the box 406 may be secured against rotation so that the turns count signals accurately reflect the rotation of the tubular 402. Alternatively or additionally, a second turns counter may be provided to sense the rotation of the box 406. The turns count signal issued by the second turns counter may then be used to correct (for any rotation of the box 406) the turns count signals.

At each interval, the rotation value may be compensated for system deflection and/or inertial torque. To compensate for system deflection, the compensator 752 may utilize the measured torque value to reference the predefined values (or formula) to find/calculate the system deflection for the measured torque value. The compensator 752 may then subtract the system deflection value from the measured rotation value to calculate a corrected rotation value. Alternatively, a theoretical formula for deflection of the tubular member 402 may be pre-programmed into the deflection compensator 752 for a separate calculation of deflection and then the deflection may be added to the top drive deflection to calculate the system deflection during each interval. Alternatively, the compensator 752 may only compensate for the deflection of the tubular member 402. Alternatively or additionally, the compensator 752 may compensate the measured torque value for inertial torque using the theoretical/empirical system moment of inertia and measured/calculated angular acceleration.

The frequency with which torque and rotation are measured may be specified by the sampler 740. The sampler 740 may be configurable, so that an operator may input a desired sampling frequency. The corrected torque and corrected rotation values may be stored as a paired set in a buffer area of computer memory. Further, the rate of change of corrected torque with respect to corrected rotation (e.g., a derivative) is calculated for each paired set of measurements by the torque rate differential calculator 736. At least two measurements are needed before a rate of change calculation can be made. In one embodiment, the smoothing algorithm 738 operates to smooth the derivative curve (e.g., by way of a running average). These three values (corrected torque, corrected rotation and rate of change of torque with respect to rotation) may then be plotted by the plotter 732 for display on the output device 720.

These three values (corrected torque, corrected rotation and rate of change of torque with respect to rotation) are then compared by the comparator 742, either continuously or at selected rotational positions, with predetermined values. For example, the predetermined values may be minimum and maximum torque values and minimum and maximum turn values.

Based on the comparison of measured/calculated/corrected values with predefined values, the process monitor 734 determines the occurrence of various events and whether to continue rotation or abort the makeup. In one embodiment, the thread engagement detection algorithm 744 monitors for thread engagement of the two threaded members. Upon detection of thread engagement a first marker is stored. The marker may be quantified, for example, by time, rotation, torque, a derivative of torque or time, or a combination of any such quantifications. During continued rotation, the seal detection algorithm 746 monitors for the seal condition. This may be accomplished by comparing the calculated derivative (rate of change of torque) with a predetermined threshold seal condition value. A second marker indicating the seal condition is stored when the seal condition is detected. At this point, the turns value and torque value at the seal condition may be evaluated by the connection evaluator 750.

For example, a determination may be made as to whether the corrected turns value and/or torque value are within specified limits. The specified limits may be predetermined, or based off of a value measured during makeup. If the connection evaluator 750 determines a bad connection, rotation may be terminated. Otherwise rotation continues and the shoulder detection algorithm 748 monitors for shoulder condition. This may be accomplished by comparing the calculated derivative (rate of change of torque) with a predetermined threshold shoulder condition value. When the shoulder condition is detected, a third marker indicating the shoulder condition is stored. The connection evaluator 750 may then determine whether the turns value and torque value at the shoulder condition are acceptable.

In one embodiment the connection evaluator 750 determines whether the change in torque and rotation between these second and third markers are within a predetermined acceptable range. If the values, or the change in values, are not acceptable, the connection evaluator 750 indicates a bad connection. If, however, the values/change are/is acceptable, the target calculator calculates a target torque value and/or target turns value. The target value may be calculated by adding a predetermined delta value (torque or turns) to a measured/corrected reference value(s). The measured/corrected reference value may be the torque value or turns value corresponding to the detected shoulder condition. In one embodiment, a target torque value and a target turns value are calculated based off of the measured/corrected torque value and turns value, respectively, corresponding to the detected shoulder condition.

Upon continuing rotation, the target detector 754 monitors for the calculated target value(s). Once the target value is reached, rotation is terminated. In the event both a target torque value and a target turns value are used for a given makeup, rotation may continue upon reaching the first target or until reaching the second target, so long as both values (torque and turns) stay within an acceptable range. Alternatively, the compensator 752 may not be activated until after the shoulder condition has been detected. Alternatively or additionally, the connection evaluator may compare the rate of change in torque with respect to rotation after the shoulder condition (see 510) to a predetermined value to determine acceptability of the connection.

Figure 10A:
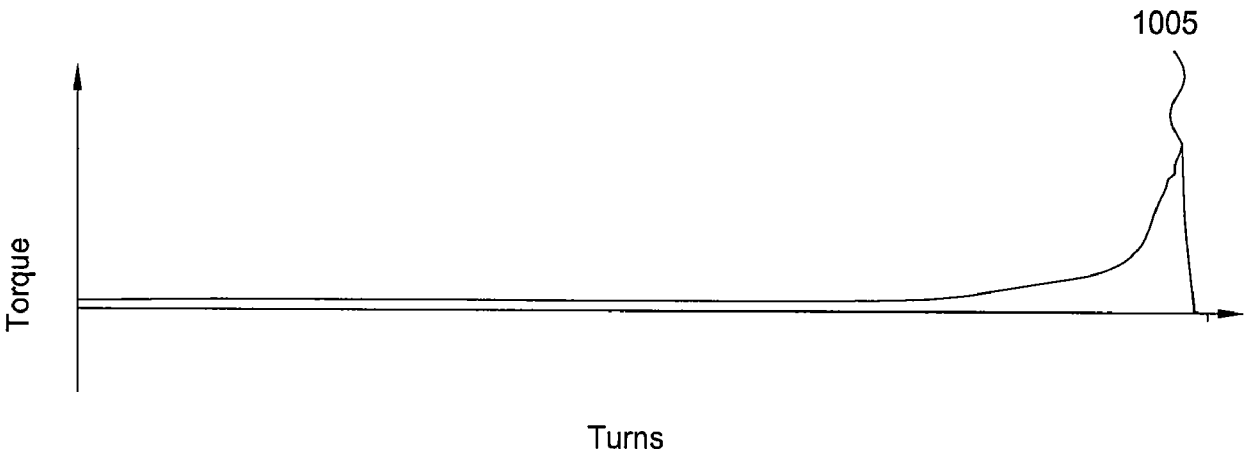
FIGS. 10A and 10B illustrate a method for preventing overshoot of the connection, according to another embodiment of the present invention.
Figure 10B:
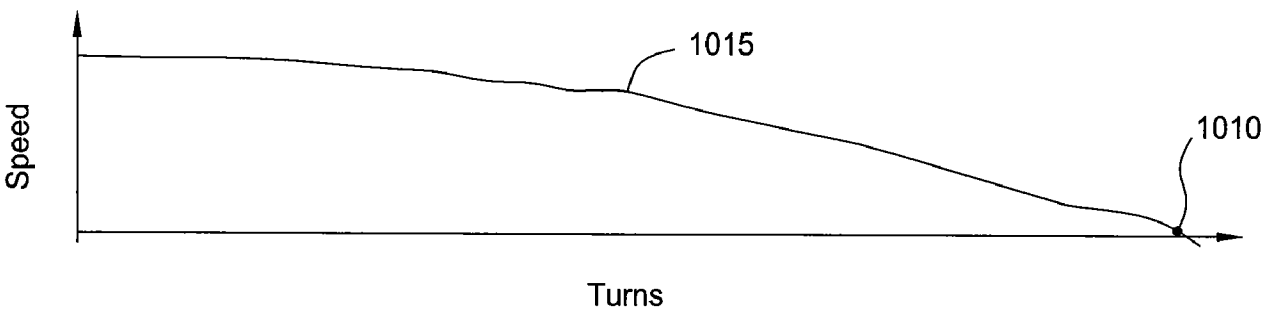

FIGS. 10A and 10B illustrate a method for preventing overshoot of the connection, according to another embodiment of the present invention. To minimize system momentum or kinetic energy, the angular speed of the top drive may begin to be slowed 1015 prior to reaching the target value 1005. Decreasing of the top drive speed may begin 1015 once the connection is substantially complete, such as at fifty percent of the recommended or maximum torque or turns value, at the seal condition, at the shoulder condition, or therebetween. The top drive speed may be gradually reduced to a target speed 1010 which may be substantially (e.g., a reduction by fifty percent or more) less than the speed 1015 at which the top drive would have been at the target (see also 315). The system kinetic energy or momentum may be negligible at the reduced speed so that the dump signal may be issued contemporaneously with detection of the target value or a slightly before (using a predicted target value time/turns).

Alternatively, the top drive may include a clutch (not shown). Instead of issuing a dump signal to the top drive, the clutch may be operated to disengage the top drive from the tubular 402 when the target is reached, thereby preventing overshoot. The disengagement may be instantaneous or gradual proximate to the target.

Figure 9A:
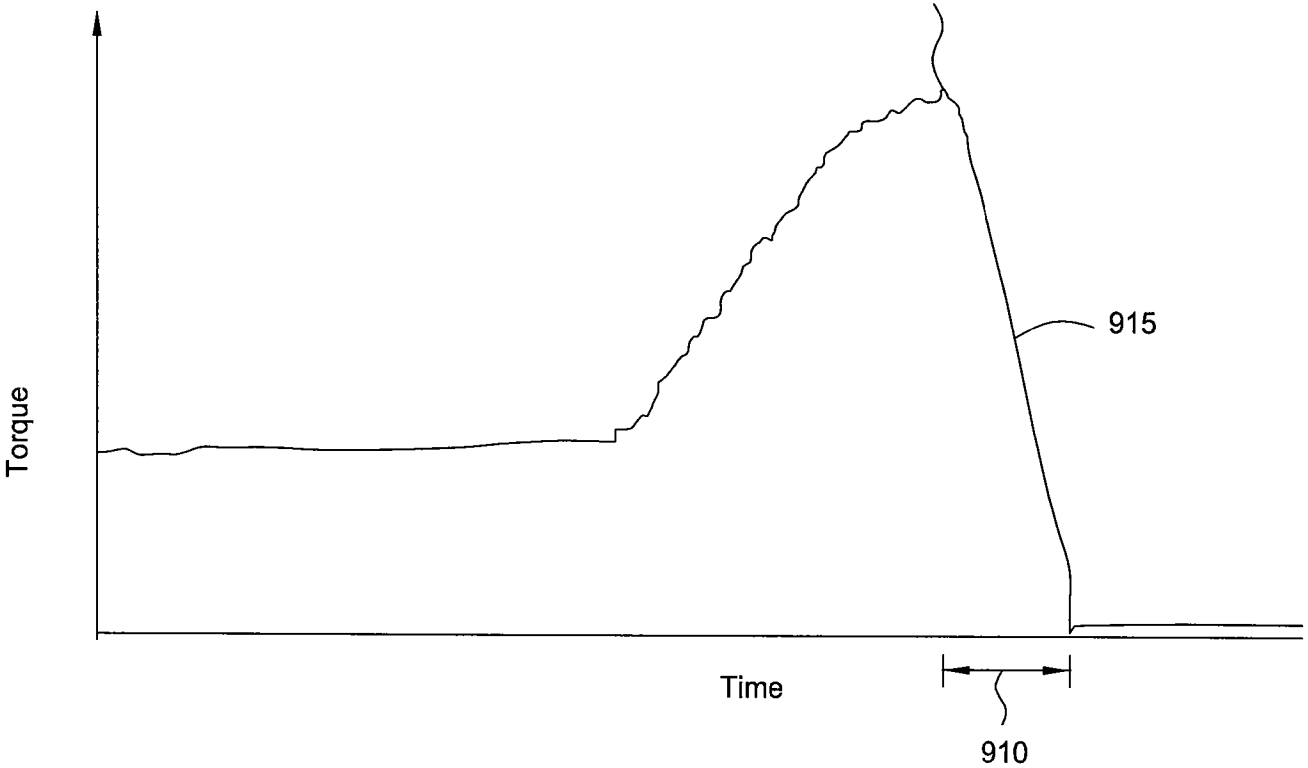
FIG. 9A illustrates a method for controllably releasing stored elastic energy of the premium tubular and/or the top drive, according to another embodiment of the present invention.

FIG. 9A illustrates a method for controllably releasing stored elastic energy of the system, according to another embodiment of the present invention. Instead of shutting off the top drive with a dump signal at the target value 905 and letting the system unwind freely, a controlled approach may be made. The output torque of the top drive may be gradually decreased 915 over a predetermined interval of time 910 control unwinding of the tubular 402 due to release of the stored elastic energy in the system. In this manner, break-out torque exerted on the connection 400 may be prevented entirely or at least maintained below a predetermined acceptable level (e.g., one-half of the final make-up torque 905).

Figure 9B:
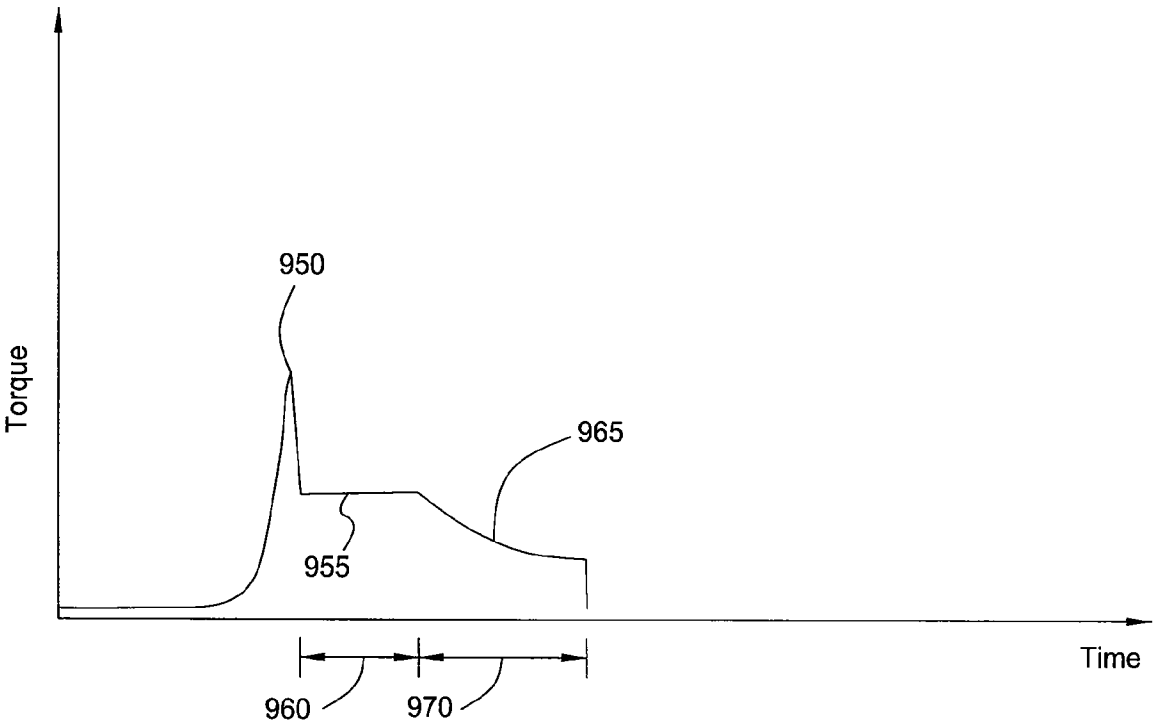
FIG. 9B illustrates an alternative method for controllably releasing stored elastic energy of the premium tubular and/or the top drive.

FIG. 9B illustrates an alternative method for controllably releasing stored elastic energy of the system. In this alternative, the output torque of the top drive 100 may be substantially reduced from the final make-up torque 950 to a second torque 955 and maintained for a predetermined interval of time 960 and then gradually reduced 965 over a second predetermined period of time 970 to control unwinding of the tubular 402 due to release of the stored elastic energy in the system. The second torque 955 may be substantially less, e.g. one-half, of the final makeup torque 950. Alternatively, the torque may be reduced in two or more steps, such as reduction to a second torque which may be two-thirds the final make up torque 950 for a predetermined period of time and then reduced to a third torque which may be one-third of the final make-up torque instead of the gradual release 965.

Alternatively, a braking system may be added to the top drive. The braking system may be a disc-brake system or a drum brake system. Alternatively, a hydraulic or pneumatic damper system may be used to dissipate the elastic energy stored in the system. The braking or damper systems may be especially useful for the clutch alternative, discussed above.

While the foregoing is directed to embodiments of the present invention, other and further embodiments of the invention may be devised without departing from the basic scope thereof, and the scope thereof is determined by the claims that follow.

The invention claimed is:

1. A method of connecting a first threaded tubular to a second threaded tubular supported by a spider on a drilling rig, comprising:

engaging the first threaded tubular with the second threaded tubular;

making up the connection by rotating the first tubular using a top drive; and controlling unwinding of the first tubular after the connection is made up, wherein the unwinding of the first tubular is controlled by substantially decreasing torque exerted by the top drive on the first tubular to a second torque and maintaining the second torque for a predetermined period of time.

2. The method of claim 1, further comprising gradually decreasing the second torque exerted by the top drive on the first tubular over a second predetermined period of time.

3. The method of claim 1, wherein the unwinding of the first tubular is controlled using a brake or damper.

4. The method of claim 1, further comprising substantially decreasing a rotational speed of the top drive before the connection is completely made up.

5. The method of claim 1, further comprising during rotation of the first tubular:

measuring torque applied by the top drive;

determining angular acceleration of at least one of the top drive and the first tubular;

determining inertial torque of the at least one of the top drive and the first tubular using the angular acceleration; and using the inertial torque to compensate a rate of change of torque after the connection is made up.

6. The method of claim 1, further comprising:

measuring torque applied by the top drive;

compensating the torque measurement using inertial torque of at least one of the top drive and the first tubular;

measuring rotation of the first tubular; and compensating the rotation measurement using deflection of at least one of the top drive and first tubular.

7. The method of claim 6, wherein:

each of the threaded tubulars has a shoulder, and the method further comprises during rotation of the first threaded tubular:

calculating a rate of change in compensated torque with respect to compensated rotation; and detecting a shoulder condition by monitoring the rate of change.

8. The method of claim 7, further comprising calculating a target rotation value using a compensated rotation value measured at the shoulder condition and a predefined rotation value, wherein the connection is made up at the target value.

9. The method of claim 8, further comprising substantially decreasing a rotational speed of the top drive prior to reaching the target rotation value.

10. The method of claim 7, further comprising determining acceptability of the threaded connection.

11. The method of claim 6, wherein the torque is measured by a torque shaft having a strain gage and rotationally coupled to the top drive and the first tubular; and the method further comprises wirelessly transmitting the measured torque to a stationary interface.

12. The method of claim 1, wherein controlling unwinding of the first tubular after the connection is made prevents negative torque from being applied to the connection or maintains negative torque applied to the connection below a predetermined acceptable level.

13. A method of controllably releasing stored elastic energy in a system, comprising:

engaging a first tubular with a second tubular;

rotating the first tubular using a top drive to connect the first tubular to the second tubular;

after the connection is made up, controlling the release of stored elastic energy in the first tubular to maintain negative torque applied to the connection below a predetermined acceptable level; and measuring torque applied by the top drive to ensure that no negative torque is applied to the made up connection.

14. The method of claim 13, further comprising controlling the release of stored elastic energy in the first tubular to prevent negative torque from being applied to the connection.

15. The method of claim 13, wherein the predetermined acceptable level is about one-half of a final make-up torque used to complete the connection.

16. The method of claim 13, wherein the release of stored elastic energy is controlled by gradually decreasing torque exerted by the top drive on the first tubular.

17. The method of claim 13, wherein the release of stored elastic energy is controlled by substantially decreasing torque exerted by the top drive on the first tubular to a second torque and maintaining the second torque for a predetermined period of time.

18. The method of claim 13, further comprising:

measuring torque applied by the top drive;

determining angular acceleration of at least one of the top drive and the first tubular;

determining inertial torque of at least one of the top drive and the first tubular using the angular acceleration; and using the inertial torque to compensate a rate of change of torque after the connection is made up.

19. The method of claim 18, wherein the rate of change of torque is a rate of decrease of torque.

20. The method of claim 13, wherein the release of stored elastic energy is controlled using a brake or damper.

21. The method of claim 13, further comprising using a hydraulic or pneumatic damper to dissipate the stored elastic energy in the first tubular after the connection is made up to prevent negative torque from being applied to the connection.

22. The method of claim 13, further comprising stopping rotation of the top drive, and then using a braking system to dissipate the stored elastic energy.

23. The method of claim 13, further comprising disengaging the top drive from the first tubular and operating a braking system to control the release of the stored elastic energy.

24. A method of connecting a first threaded tubular to a second threaded tubular supported by a spider on a drilling rig, comprising:

engaging the first threaded tubular with the second threaded tubular;

making up the connection by rotating the first tubular using a top drive; and controlling unwinding of the first tubular after the connection is made up, wherein the unwinding of the first tubular is controlled by gradually decreasing torque exerted by the top drive on the first tubular.

25. A method of connecting a first threaded tubular to a second threaded tubular supported by a spider on a drilling rig, comprising:

engaging the first threaded tubular with the second threaded tubular;

making up the connection by rotating the first tubular using a top drive;

substantially decreasing a rotational speed of the top drive before the connection is completely made up; and controlling unwinding of the first tubular after the connection is made up.

26. A method of connecting a first threaded tubular to a second threaded tubular supported by a spider on a drilling rig, comprising:

engaging the first threaded tubular with the second threaded tubular;

making up the connection by rotating the first tubular using a top drive;

controlling unwinding of the first tubular after the connection is made up; and during rotation of the first tubular:

measuring torque applied by the top drive;

determining angular acceleration of at least one of the top drive and the first tubular;

determining inertial torque of the at least one of the top drive and the first tubular using the angular acceleration; and using the inertial torque to compensate a rate of change of torque after the connection is made up.

27. A method of connecting a first threaded tubular to a second threaded tubular supported by a spider on a drilling rig, comprising:

engaging the first threaded tubular with the second threaded tubular;

making up the connection by rotating the first tubular using a top drive;

controlling unwinding of the first tubular after the connection is made up;

measuring torque applied by the top drive;

compensating the torque measurement using inertial torque of at least one of the top drive and the first tubular;

measuring rotation of the first tubular; and compensating the rotation measurement using deflection of at least one of the top drive and first tubular.

28. The method of claim 27, wherein:

each of the threaded tubulars has a shoulder, and the method further comprises during rotation of the first threaded tubular:

calculating a rate of change in compensated torque with respect to compensated rotation; and detecting a shoulder condition by monitoring the rate of change.

29. The method of claim 28, further comprising determining acceptability of the threaded connection.

30. The method of claim 28, further comprising calculating a target rotation value using a compensated rotation value measured at the shoulder condition and a predefined rotation value, wherein the connection is made up at the target value.

31. The method of claim 30, further comprising substantially decreasing a rotational speed of the top drive prior to reaching the target rotation value.

32. The method of claim 30, wherein the unwinding of the first tubular is controlled by gradually decreasing torque exerted by the top drive or by substantially decreasing torque exerted by the top drive to a second torque and maintaining the second torque for a predetermined period of time after detecting the target rotation value.

33. The method of claim 30, further comprising operating a clutch to disengage the top drive from the tubular after detecting the target rotation value, wherein the unwinding of the first tubular is controlled using a brake or damper.

34. The method of claim 27, wherein the torque is measured by a torque shaft having a strain gage and rotationally coupled to the top drive and the first tubular; and the method further comprises wirelessly transmitting the measured torque to a stationary interface.

35. A method of controllably releasing stored elastic energy in a system, comprising:

engaging a first tubular with a second tubular;

rotating the first tubular using a top drive to connect the first tubular to the second tubular; and after the connection is made up, controlling the release of stored elastic energy in the first tubular to maintain negative torque applied to the connection below a predetermined acceptable level, wherein the predetermined acceptable level is about one-half of a final make-up torque used to complete the connection.

36. A method of controllably releasing stored elastic energy in a system, comprising:

engaging a first tubular with a second tubular;

rotating the first tubular using a top drive to connect the first tubular to the second tubular; and after the connection is made up, controlling the release of stored elastic energy in the first tubular to maintain negative torque applied to the connection below a predetermined acceptable level, wherein the release of stored elastic energy is controlled by substantially decreasing torque exerted by the top drive on the first tubular to a second torque and maintaining the second torque for a predetermined period of time.

37. A method of controllably releasing stored elastic energy in a system, comprising:

engaging a first tubular with a second tubular;

rotating the first tubular using a top drive to connect the first tubular to the second tubular;

after the connection is made up, controlling the release of stored elastic energy in the first tubular to maintain negative torque applied to the connection below a predetermined acceptable level;

measuring torque applied by the top drive;

determining angular acceleration of at least one of the top drive and the first tubular;

determining inertial torque of at least one of the top drive and the first tubular using the angular acceleration; and using the inertial torque to compensate a rate of change of torque after the connection is made up.

38. The method of claim 37, wherein the rate of change of torque is a rate of decrease of torque.

39. A method of controllably releasing stored elastic energy in a system, comprising:

engaging a first tubular with a second tubular;

rotating the first tubular using a top drive to connect the first tubular to the second tubular; and after the connection is made up, controlling the release of stored elastic energy in the first tubular to maintain negative torque applied to the connection below a predetermined acceptable level, wherein the release of stored elastic energy is controlled by gradually decreasing torque exerted by the top drive on the first tubular.

* * * * *